United States Patent [19]

Williams

[11] 4,005,892

[45] Feb. 1, 1977

[54] DEBRIS-RETRIEVING CANE

[76] Inventor: Walter L. Williams, 5739 Camerford Ave., Los Angeles, Calif. 90038

[22] Filed: June 11, 1975

[21] Appl. No.: 586,089

[52] U.S. Cl. ..... 294/1 R; 15/257.1; 15/257.7; 294/19 R; 294/55

[51] Int. Cl.[2] ..... A01K 29/00; A47L 13/52

[58] Field of Search ..... 294/1 R, 19 R, 50.5–50.9, 294/51, 52, 53.5, 55, 57, 58, 103, 104, 115; 15/104.8, 257.1, 257.2, 257.4, 257.6, 257.7; 56/400.11–400.13; 135/45 R, 45 A, 47

[56] References Cited

UNITED STATES PATENTS

| | | | |
|---|---|---|---|
| 497,401 | 5/1893 | Bates | 15/257.7 |
| 2,196,116 | 4/1940 | Johnson | 294/50.9 |
| 3,002,209 | 10/1961 | McKinstry | 15/257.1 |
| 3,018,502 | 1/1962 | Lossius | 15/257.2 |
| 3,264,809 | 8/1966 | Jackson | 56/400.12 |
| 3,265,429 | 8/1966 | Shatt | 294/19 R |
| 3,382,523 | 5/1968 | Parsisson | 15/257.2 |
| 3,431,008 | 3/1969 | Narita | 294/55 |
| 3,456,663 | 7/1969 | Blum | 294/53.5 |
| 3,796,453 | 3/1974 | Grimes | 294/1 R |
| 3,827,098 | 8/1974 | Sanderson | 294/1 R X |

*Primary Examiner*—Johnny D. Cherry

[57] ABSTRACT

A debris-retrieving cane comprising a longitudinal cane shaft member having an upper handle portion and effectively having a lower ground-surface-engageable portion, with said cane shaft member being provided adjacent to the bottom end thereof with a hollow debris-receiving receptacle means and effectively with debris-movement means for use in moving and manipulating a quantity of debris relative to the debris-receiving receptacle means into received relationship for removal of received and retrieved debris for subsequent emptying elsewhere. The entire device closely simulates and is capable of use as an effective cane concurrently with and independent of its use as a debris retriever and is also capable of use as an auxiliary weapon in the event that the person carrying the device is assaulted, attacked, or threatened.

5 Claims, 18 Drawing Figures

22a
36a
80
82
58a
76
78
54a
74
30a
42a
34a
62a
40a
68a
42a
-28-
32a
44a
46a
70a
26b
92
86
90
88
84
72a
38a
22b
42b
46b
28b
13
50a
36a
30b
32b
34b
20a
20b
32a
30a
82
42a
44a
92
90
88
86
84
58a
40a
60a
56a
28a
26a
52a
32b
28b
26b
42b
30b

FIG. 14
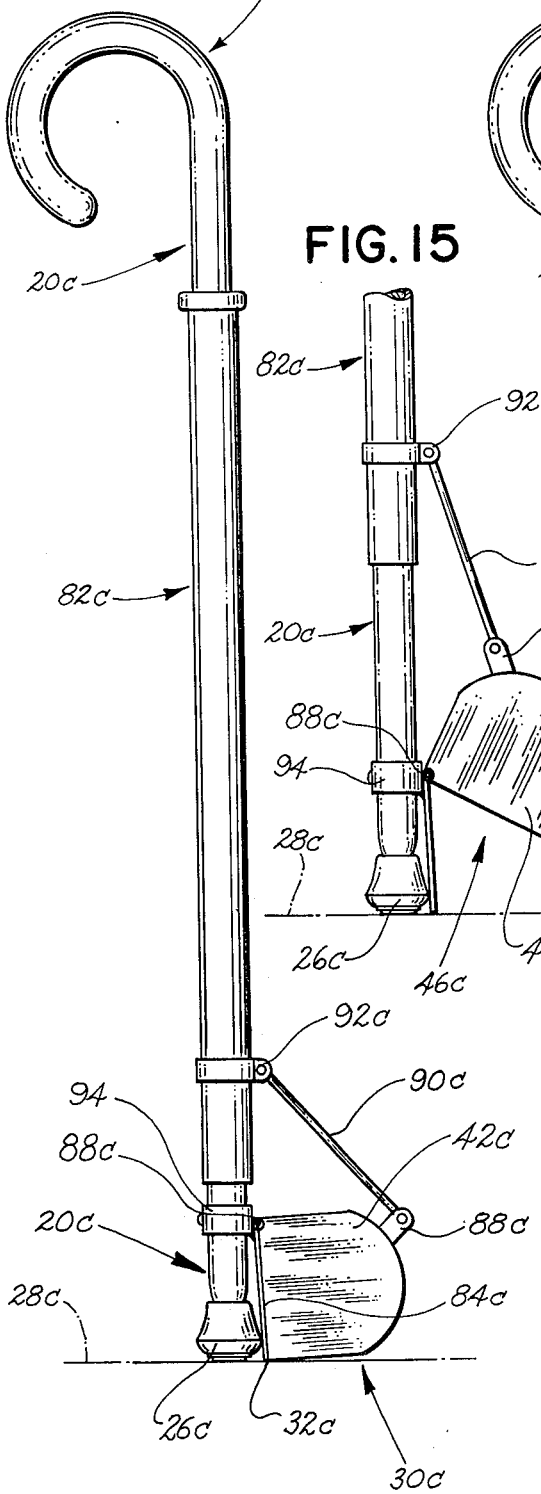
FIG. 15
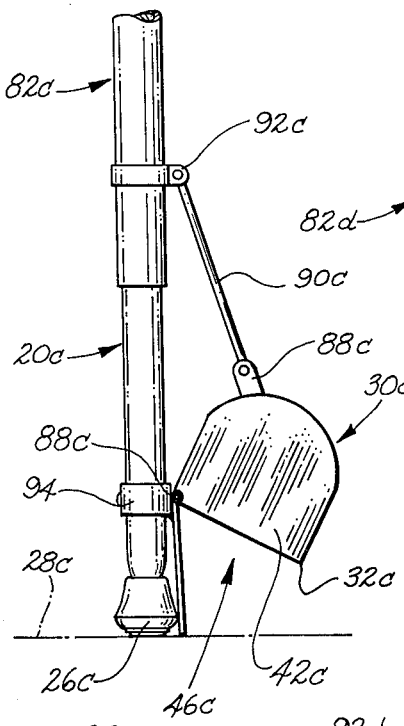
FIG. 16
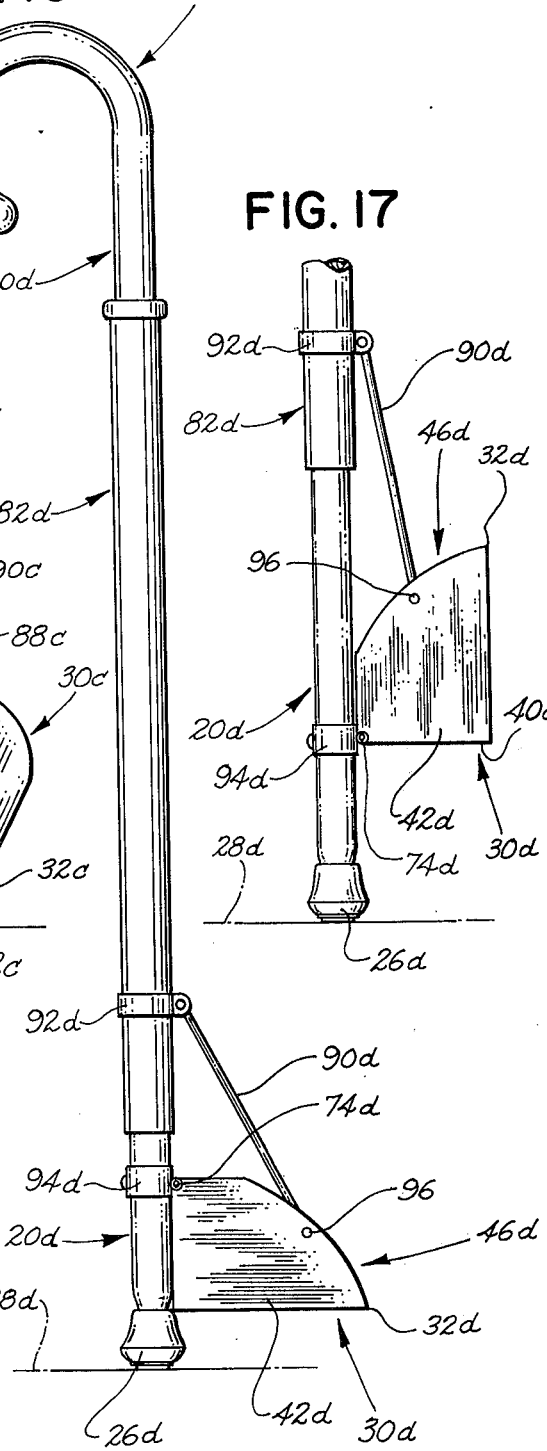
FIG. 17

DEBRIS-RETRIEVING CANE

BACKGROUND OF THE INVENTION

The field of the invention is that of a portable debris retriever of a type capable of being transported to a retrieving location and there used for debris-receiving purposes in a manner such that debris is received in a receptacle or receiver for transporting to an appropriate debris disposal location which may be a gutter, an appropriate debris receiver, such as a trash can, or the like, for the subsequent emptying-out of the relatively small debris receiver of the device. There have been prior art portable debris retrievers, of the general type just defined above, in the past. However, they have not been entirely functional for the primary purposes of the present invention, as will be fined in greater particularity hereinafter. Among such prior art portable debris retrievers is a type of prior art construction embodying a portable dust pan carried at the bottom end of a longitudinal handle and sometimes hingedly mounted so that it can be moved to an appropriate location where debris is located and moved into a position with the dust-pan adjacent to the debris for the sweeping of the debris by a small portable broom into the portable dust-pan, where it may be collected along with other such sweepings from various locations until the storage part of the portable dust-pan has become relatively fully loaded and requires that it be emptied into a larger trash receptacle or the like. There has also been another type of prior art portable debris retriever intended primarily for retrieving debris objects consisting of pieces of paper of one kind or another and wherein the debris retriever has consisted primarily of an impaling point carried at the bottom or forward end of a longitudinal handle portion adapted to be carried to a location where a paper object is resting on a ground surface and to then be employed by driving the impaling point into the paper object to retrieve it from the ground surface. This usually requires that a larger trash receptacle be nearby and employed frequently for receiving one or more paper objects which have been so impaled on the impaling point because the impaling point is not capable of retrieving and storing many such objects. Because of its lack of storage capacity, it must have the previously impaled paper objects removed therefrom quite frequently in order to remain operative. There are also certain other generally similar debris-retrieving portable devices, but in general they are not ideally suited to the purpose of the present invention, which is to provide a multi-purpose device which fully simulates and is completely capable of being used as a conventional cane while a person is out walking his pet (usually a dog) and if and when the dog may defecate on a public sidewalk, or parking strip, or other such public location, the double-purpose debris retriever may be quickly caused to operate in an effective stool-retrieving fashion which will retrieve, pick up, and store the stool until such time as the person either empties it into an appropriate gutter, trash receptacle, or the like, or returns home from his walk with his pet and empties the collected debris out into his home trash can, and with the device being fully functional as a cane during the walk home. It will readily be seen that this is not possible with either of the well-known prior art types of portable debris retrievers briefly outlined above nor is this advantageous mode of operation possible with any of the other prior art portable debris-retrieving devices known to me. Therefore, it is obvious that it would be highly desirable to provide a portable debris retriever having the advantages mentioned above — that is, being fully functional and usable during a walk as a walking cane (and, incidentally, as a weapon in the event that the person might be assaulted, attacked, or threatened during such a walk) and yet being readily usable whenever the retrieval of his pet's stool becomes necessary, or is thought desirable, and, thereafter, being adapted to readily store the retrieved stool (if it is not emptied out nearby) without in any way interfering with the other uses of the device as a walking cane, or weapon, and adapted to be emptied-out later at any appropriate disposal location or upon returning home, and it is precisely such a highly desirable and highly advantageous, novel, debris-retrieving cane which I have invented and which has the highly desirable advantages, functions, and end-results mentioned above which flow from and occur by reason of the specific structural and cooperational features of the invention pointed out hereinafter.

SUMMARY OF THE INVENTION

Generally speaking, the debris-receiving cane of the present invention comprises a longitudinal cane shaft member, usually having a handle portion adjacent to or at an upper end thereof and usually effectively provided at an opposite lower end thereof with a ground-surface-engageable cane tip member portion and which, in one preferred form, may removably carry a compressible elastomeric, friction-providing cane tip means, such as a resilient elastomeric slip-over sleeve member, or the like (although not specifically so limited), and with the longitudinal cane shaft member being further provided adjacent to the bottom end thereof with a hollow debris-receiving receptacle means having a ground-surface-engageable entry lip portion movable into engagement with a ground surface for positioning adjacent to a quantity of debris which is to be removed and, in such position, defining at least a portion of a receiving entry opening provided in said debris-receiving receptacle means and effectively communicating the exterior and the hollow interior thereof. The debris-receiving receptacle means is effectively attached (in certain forms, fixedly, and, in other forms, movably or hingedly) with respect to a lower portion of the cane shaft member in a manner such as to be capable of being positioned in a debris-receiving position, with said ground-surface-engageable entry lip portion projecting away from said cane shaft member in a direction adapted to be placed in said engagement with a ground surface, with said entry opening effectively open toward and adapted for the reception of a quantity of ground-supported debris which is to be removed. Furthermore, certain preferred forms of the invention may also effectively include debris-movement-and-manipulation means for effectively moving and manipulating a quantity of debris which is to be removed along a ground surface initially supporting such debris toward said ground-surface-engaged entry lip portion for effective forced movement relative thereto through said entry opening and effectively into said hollow interior of the debris-receiving receptacle means. In one form of the invention, the debris-receiving receptacle means is of a two-element type including at least two relatively movable portions capable of being moved from a spaced-apart, open relationship into a closely adjacent and abutting closed relationship, with said previously mentioned debris-movement-and-manipulation means effectively comprising one of said two relatively movable portions of said debris-receiving receptacle means adapted to be positioned adjacent to one side of a quantity of ground-surface-supported debris when said other relatively movable portion of said debris-receiving receptacle means is positioned in opposition thereto on the other side of said ground-surface-supported debris for positive debris movement and manipulation from such ground-supported initial condition into fully-received-and-retained condition within the debris-receiving receptacle means when said two portions thereof are relatively moved into said closed relationship from said initial relatively open relationship. In the above-mentioned form of the invention, operating means (which, in one preferred version, comprises operating sleeve means) is vertically longitudinally carried by a portion of the longitudinal cane shaft member for manually initiated movement between a debris-receiving receptacle means operative, or effectively open, relationship and a debris-receiving receptacle means inoperative, or effectively closed, relationship and, in a preferred version thereof, said operating means is provided with effective connecting rod means interconnecting said operating means and a longitudinally movable portion of the two-element, debris-receiving receptacle means whereby to cause relative movement of at least one of the two elements of the receptacle means with respect to the other element thereof between said open (operative) relationship thereof and said closed (inoperative) relationship thereof, and vice versa. In a preferred form of the above-mentioned version, the longitudinally movable operating means comprises sleeve means vertically longitudinally frictionally slidably carried by said exterior portion of the longitudinal cane shaft member for movement between said two different extreme positions, in either of which it will remain by reason of its frictional engagement therewith.

In another alternate preferred form of the invention, the debris-movement-and-manipulation means comprises a longitudinal handle portion and an effective debris-engaging spatula portion at the bottom end of said longitudinal handle portion, with both being normally mounted in fastened relationship, in longitudinal, laterally adjacent, substantially parallel abutment and engagement with a corresponding longitudinal surface of said cane shaft member, and with the fastened parts being effectively provided with controllably openable fastening means (in a preferred form at multiple locations along the lengths thereof) for normally fastening and retaining said longitudinal handle portion and said debris-engaging spatula member immediately adjacent to and in longitudinally contiguous relationship with respect to said cane shaft member until controllable manual unfastening of said fastening means occurs.

In one preferred form of the invention, the debris-receiving receptacle means is fixedly attached to said lower portion of said cane shaft member, normally in an outwardly effectively open position with said ground-surface-engageable entry lip portion being substantially outwardly positioned and with said entry opening being positioned thereabove in a substantially outwardly open direction. In an alternate form thereof, the debris-receiving receptacle means is effectively vertically hingedly attached with respect to a lower portion of said cane shaft member at a location adjacent to the opposite end of the debris-receiving receptacle means from the entry opening defining portion thereof, and positioning means is provided which is effectively cooperable with respect to said hingedly mounted debris-receiving receptacle means for normally positioning it in an effectively upwardly open position with said entry opening substantially at the top thereof, but capable of being controllably released whereby to effectively cause said hingedly mounted debris-receiving receptacle means to hingedly move outwardly and downwardly into an effectively outwardly directed position with respect to the lower part of said cane shaft member portion in an outwardly effectively open position with said ground-surface-engageable entry lip portion being substantially outwardly positioned and with said entry opening being positioned thereabove in a substantially outwardly open relationship.

In the latter above-mentioned preferred form of the invention, the controllably openable and closable fastening means includes a lower portion which effectively comprises said previously mentioned positioning means and effectively functions for and provides for cooperative interengagement between a lower part of said debris-movement-and-manipulation means and said vertically hingedly mounted debris-receiving receptacle means when said receptacle means is in said normal, retracted, upwardly open relationship for maintaining said debris-receiving receptacle means in said retracted, upwardly open relationship until the controllable unfastening of said bottom fastening portion of said fastening means occurs, which functions to effectively release said previously retracted positioning of said debris-receiving receptacle means whereby to allow said vertically hinged debris-receiving receptacle means to hingedly move outwardly and downwardly into a debris-receiving, effectively outwardly directed relationship.

OBJECTS OF THE INVENTION

With the above points in mind, it is an object of the present invention to provide a novel portable walking-stick-or-cane-simulating debris-retriever capable of functioning as a walking stick or cane (or weapon in the case of assault, attack, or the like, while walking) and also capable, whenever desired, of being used as a debris-receiver (usually a cat-or-dog-stool retriever) and thereafter to function as a storing device for the previously retrieved debris while again functioning as a walking cane until it is convenient to empty out the debris (usually a cat or dog stool) at a later time and at a convenient location).

It is a further object of the present invention to provide a novel device of the character referred to herein, generically and/or specifically, and which may include any or all of the features referred to herein (or functional equivalents), either individually or in combination, and which is of relatively inexpensive, simple, easy-to-manufacture, and easy-to-use construction suitable for ready mass production and distribution thereof in any of its various forms at relatively low cost, both as to the initial capital cost (including tooling and production set-up cost) and as to the subsequent per-unit manufacturing cost, whereby to be conducive to widespread production, distribution, and sale of the novel walking-cane debris-retrieval device of the present invention for the general purposes outlined herein or for any substantially equivalent or similar purposes.

Further objects are implicit in the detailed descriptions which follow hereinafter (which are to be considered as exemplary of, but not specifically limiting, the present invention), and said objects will be apparent to persons skilled in the art after careful study of the detailed descriptions which follow.

For the purpose of clarifying the nature of the present invention, several exemplary embodiments of the invention are illustrated in the hereinbelow-described figures of the accompanying three sheets of drawings and are described in detail hereinafter.

BRIEF DESCRIPTION OF THE DRAWINGS

FIG. 14 is a side elevational view generally similar to FIG. 1, FIG. 7, and FIG. 11, but illustrates a further slight modification comprising a variant form of the FIG. 11 form of the invention wherein the operating sleeve member moves a pivotally mounted, debris-receiving receptacle means relative to a hinged attachment thereof with respect to a normally fixedly positioned cover portion and, thus, in effect, comprises a substantially reversed arrangement from the showing of FIG. 11 and FIG. 12, but otherwise similar in construction and mode of operation.

FIG. 15 is an operational view with the operating sleeve member in an uppermost position for causing the separation of the operating edges of the debris-receiving receptacle means and the cover therefor. In other words, FIG. 15 is a view which is functionally equivalent to FIG. 12 of the preceding variation of the invention, although it should be understood that, for space-saving reasons, it is not shown in a tilted-toward-the-right relationship similar to the showing of FIG. 12, which it would normally assume when actually in an immediately pre-stool-retrieving relationship with respect to a ground surface, which operation would proceed almost exactly the same as the showing of FIG. 12 illustrating the previous form of the invention.

FIG. 16 is a side elevational view similar to FIGS. 1, 7, 11, and 14, but illustrating a further slight variation of the operating-sleeve version of the invention wherein the debris-receiving receptacle means is hingedly carried by the lower part of the longitudinal cane shaft member portion in a manner very similar to the form of the invention illustrated in FIGS. 7–10, but, in this case, having the operating sleeve member pivotally connected to an outer part of the hingedly mounted, debris-receiving receptacle means in a manner similar to the interconnection of the operating sleeve of the FIGS. 11 and 12 version of the invention to the cover member of the debris-receiving receptacle means. In the FIG. 16 form, it is connected directly by said connecting rod to an outer portion of the debris-receiving receptacle means itself, which, being pivotally mounted, can be caused to move between the two different positions thereof shown in FIGS. 16 and 17. In this view, it should be understood that when debris, such as a pet stool, is to be retrieved, the entire longitudinal cane shaft member portion is tilted toward the right as viewed in FIG. 16 until the rightwardly positioned extreme entry lip portion of the outwardly open debris-receiving receptacle means engages the underlying ground surface adjacent to a quantity of debris such as a stool, or the like, for shoving thereunder while forcibly moving the operating sleeve member toward the upper position thereof shown fragmentarily in FIG. 17 for the retrieval of the pet stool.

DESCRIPTION OF THE PREFERRED EMBODIMENTS

FIGS. 1–6 inclusive illustrate one exemplary non-specifically-limiting first embodiment of the invention wherein the debris-retrieving cane takes the form of a longitudinal cane shaft member, generally designated at 20, which, in the example illustrated, is provided at its upper end with a handle member portion, indicated generally at 22, which is shown as taking one particular form wherein it comprises an effectively curved, downwardly concave, hook-shaped handle member portion, although it is not specifically so limited in all forms of the invention. The longitudinal cane shaft member, indicated generally at 20, is also effectively provided with a lower or bottom end 24 (actually, a separate extension end attached thereto by the hereinafter described bottom fastening means), which is most clearly shown in FIG. 5 and which, in said exemplary form, is provided with and removably carries a compressible elastomeric friction-providing cane tip slip-over sleeve member 26, which provides good frictional, non-slip engagement with a ground surface, such as that shown fragmentarily and in somewhat diagrammatic, simplified form at 28, when the entire device is used as, and effectively functions as, a substantially conventional walking cane. Of course, the cane tip slip-over sleeve member 26 can be modified substantially to assume a variety of different forms and, in certain cases, may even be eliminated, all within the broad scope of the present invention.

Figures 1, 1A, 2, 3, 4, 5, 6:
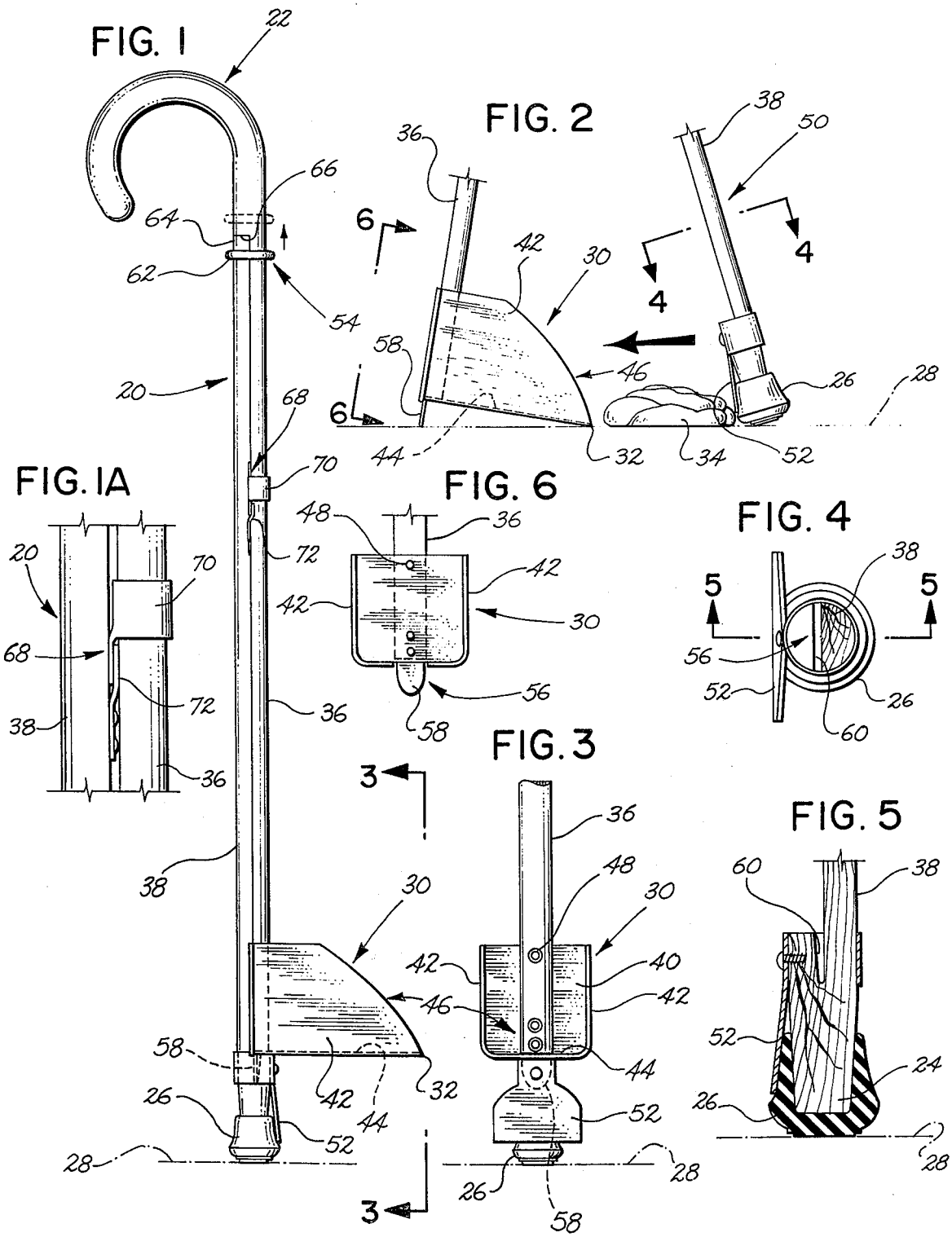
FIG. 1 is a side elevational view of one exemplary embodiment of the present invention showing it in fully assembled relationship suitable for use as a walking cane and also adaptable for secondary use, if needed, as a weapon in the event that a person out walking with the device of the present invention is assaulted or attacked during the course of such a walk. The device is also readily placed in a condition for use as a stool-retriever in a manner such as is shown fragmentarily in FIG. 2 whenever a pet (usually a dog) being walked by the person possessing the cane of FIG. 1 excretes a stool in a public place, from which location it is desirable that the stool be removed.
FIG. 1A is a fragmentary, greatly enlarged, elevational view of just that portion of FIG. 1 which is provided with the upper intermediate fastening means portion and clearly illustrates the fastened relationship thereof.
FIG. 2 is a fragmentary view illustrating the fact that the longitudinal cane shaft member actually comprises a pair of adjacent longitudinal members, one of them comprising a front longitudinal cane shaft member portion carrying at the bottom thereof a debris-receiving receptacle means and the rear one of which is normally effectively fastened in parallel relationship with respect thereto, but is controllably separable therefrom and carries at the bottom thereof a debris-movement-and-manipulation member. The bottom portions of said two separable portions of the cane shaft are shown fragmentarily in FIG. 2 in separated debris-removing relationship for sweeping a stool into the debris-receiving receptacle means prior to re-engaging the two cane portions in the manner of FIG. 1 for the subsequent transporting of the stool to an appropriate disposal location for disposal in a gutter, trash can, or other suitable stool-receiver. It should be noted that when reassembled in the manner of FIG. 1, even after receiving a stool in the manner of FIG. 2, the entire reassembled device can be used again as a walking cane.
FIG. 3 is a fragmentary, front elevational view of the device of FIG. 1 as viewed in the direction of the arrows 3—3 of FIG. 1 and more clearly shows the debris-receiving receptacle means carried by a lower portion of the cane shaft member so as to be available for use in the manner shown in FIG. 2 whenever it is needed.
FIG. 4 is a somewhat enlarged, cross-sectional view taken substantially along the plane and in the direction indicated by the arrows 4—4 of FIG. 2 and clearly shows the temporarily separated rear longitudinal shaft member portion which actually functions as a longitudinal handle portion for the debris-movement-and-manipulation means of FIG. 4 and also clearly shows in elevation the lower debris-engaging spatula portion at the bottom thereof.
FIG. 5 is another sectional view, this time taken substantially along the vertical plane and in the direction indicated by the arrows 5—5 of FIG. 4 and clearly illustrates, in vertical plane section, a lower one of a pair of portions of controllably openable fastening means for normally fastening and retaining the longitudinal handle portion of FIGS. 2, 4, and 5 in engaged relationship with the lower part of the other cane shaft member portion shown fragmentarily at the left side of FIG. 2 and in FIG. 6 and which carries the debris-receiving receptacle means.
FIG. 6 is a fragmentary elevational view of the rear of the lower part of the front longitudinal cane shaft member portion of FIG. 2 taken substantially along the plane and in the direction indicated by the arrows 6—6 of FIG. 2 and clearly shows the other cooperating portion of the bottom part of the controllably openable fastening means which takes the form of a downwardly projecting tongue portion which cooperates with the downwardly projecting recess means carried by the cooperable lower part of the longitudinal handle portion of the debris-manipulation means, which also comprises the rear portion of the dual longitudinal cane shaft member shown in fully-assembled relationship in FIG. 1; said downwardly directed receiving groove of said debris-movement-and-manipulation means being best shown in FIGS. 4 and 5 and being adapted to receive the downwardly directed tongue of FIGS. 2 and 6 in the fully engaged and received fastening and positioning manner best illustrated near the bottom of FIG. 1 and FIG. 3.

The longitudinal cane shaft member, indicated generally at 20, is effectively provided adjacent to the bottom end thereof with a hollow, debris-receiving receptacle means, such as the exemplary one generally indicated at 30, which has a ground-surface-engageable entry lip portion, such as the exemplary one indicated at 32, which is adapted to be moved into engagement with a ground surface, such as that shown fragmentarily and in simplified form at 28 in FIGS. 1, 2, and 3, for positioning adjacent to a quantity of debris (such as a pet's stool) as indicated at 34 in FIG. 2, for example, and which is to be removed. Of course, it should be noted that, in the example illustrated, the longitudinal cane shaft member 20 is of dual composite construction including two normally adjacently held, longitudinal cane shaft member portions, such as indicated at 36 and 38, which have to be unfastened, disengaged, and effectively separated from each other before the debris-receiving receptacle means, indicated generally at 30, is adapted to have its entry lip portion 32 moved into engagement with the ground surface 28 adjacent to the debris, or pet's stool, 34 in the manner shown in FIG. 2. This will all be further explained hereinafter.

In the exemplary first form of the invention illustrated, the debris-receiving receptacle means 30 consists of a substantially vertical back wall portion 40 provided with two laterally spaced, substantially parallel, upstanding, outwardly extending, similar side wall portions, each designated by the reference numeral 42 and all interconnected by a normally outwardly extending bottom wall portion 44 connected across the bottom edges of the two sidewall portions 42 and the rear wall portion 40, thus defining at the outer or right-hand end of the debris-receiving receptacle means 30, as viewed in FIGS. 1 and 2, what might be termed a receiving entry opening, as indicated at the location designated generally by the reference numeral 46, which effectively communicates the exterior and the hollow interior of the debris-receiving receptacle means 30.

In the exemplary first form of the invention illustrated, the front longitudinal cane shaft member portion 36 has the upstanding back wall 40 of the debris-receiving receptacle means 30 attached thereto by suitable fastener means, such as indicated at 48, as best shown in FIGS. 3 and 6, which may be threaded fastener means, adhesive or cohesive fastener means or any desired type of fastener means, or the parts may be integrally constructed or integrally attached during the manufacture or fabrication thereof. All of these arrangements, and other equivalents, are within the broad scope of the present invention.

The novel exemplary first form of the present invention also includes a debris-movement-and-manipulation means for effectively moving and manipulating a quantity of debris along a ground surface initially supporting such debris toward said ground-surface-engaged entry lip portion, such as the exemplary one shown at 32 in FIG. 2, for forced movement thereover and through the entry opening, such as shown at 46, into the hollow interior of the debris-receiving receptacle means 30. In the exemplary first form of the invention illustrated, said debris-movement-and-manipulation means comprises the rear one of said two longitudinal cane shaft member portions previously referred to and designated by the reference numeral 38 and which effectively functions when unfastened and separated into operative relationship in the manner most clearly shown (fragmentarily) in FIG. 2, as a longitudinal handle portion for the entire debris-movement-and-manipulation means which is independently, when separated, designated by the reference numeral 50. It should be noted that at the lower end of said rear longitudinal cane shaft member portion 38, which functions as the longitudinal handle portion for the debris-movement-and-manipulation means 50, a debris-engaging spatula portion 52 is provided for use in actual abutment with a quantity of debris, such as the pet's stool indicated at 34 in FIG. 2, when it is being forcibly displaced and moved over the entry lip portion 32 and through the entry opening 46 into the hollow interior of the debris-receiving receptacle means 30.

However, the above-described debris-retrieval operation, as illustrated in FIG. 2, only comes into play at those times when a quantity of debris, such as a pet's stool, is to be retrieved, and this requires the controllable unfastening of the fastening means normally holding the two longitudinal cane shaft member portions together in the assembled, fastened relationship clearly shown in FIG. 1 when the entire device functions primarily as a walking cane and as a transporting device for any debris (pet's stool) which has been previously retrieved in the manner shown in FIG. 2.

The above-mentioned fastening means comprises upper fastening means, such as generally designated at 54, as best shown in FIG. 1, and lower two-element fastening means, generally designated by the reference numeral 56, comprising a male downwardly projecting tongue member 58 and a corresponding downwardly directed, receiving, groove-shaped recess 60 which can be positively engaged, one within the other, in the manner clearly shown in FIG. 1 to lock the two bottom parts of the two longitudinal cane shaft member portions 36 and 38 firmly together in the closely adjacent, parallel, assembled, fastened relationship shown in FIG. 1 where they function as a single effectively unitary member. The upper fastening means portion 54 is shown as comprising a vertically rollable or slidable elastomeric O-ring 62 which, when in the solid-line position shown in FIG. 1, positively fastens the top end 64 of the rear longitudinal cane shaft member portion 38 (the effective handle portion of the debris-movement-and-manipulation means 50) in firmly locked position immediately behind the corresponding part of the front longitudinal cane shaft member portion 36 and immediately under the shoulder portion 66 defined therein. This provides both top and bottom positive fastening of the two longitudinal cane shaft member portions 36 and 38 together, with the adjacent, centrally positioned, flat surfaces thereof in positive abutment and with the outer semi-circular, half-round configurations thereof in opposition so that they together effectively define a circular configuration and so that the entire device effectively functions as a single unitary structure. It should be noted that the two lower fastening elements of the bottom fastening means portion 56 may also be said to effectively comprise positioning means since, when engaged, they provide a positive positioning relationship between the two longitudinal cane shaft member portions 36 and 38.

When the assembled device of FIG. 1 is to be placed in debris-retrieval condition, it is only necessary for a user of the device to manually roll the elastomeric O-ring 62 upwardly to a position above the upper end 64 of the rear cane shaft member portion 38 and above the shoulder 66 into an unlocked position, such as is shown in broken lines in FIG. 1. Then the upper end 64 of the rear longitudinal cane shaft member portion 38 can be moved rearwardly until it clears the locking shoulder 66 and then it can be moved slightly downwardly immediately thereafter or concurrently therewith so as to disengage the groove-shaped receiving recess 60 from the downwardly projecting tongue 58 of the two-element lower fastening means portion 56, and it will be found that the entire debris-movement-and-manipulation means 50 can then be rotated substantially 180° around a vertical axis and moved to a position in opposition to the entry lip portion 32 of the debris-receiving receptacle means 30 and on the opposite side thereof from a quantity of debris, such as a pet's stool as indicated at 34, for a debis-retrieval operation such as is illustrated in FIG. 2. As soon as the pet's stool has been retrieved, the tongue 58 may be re-engaged within the grooved recess 60 and the upper end 64 may be moved into a position underlying the upper locking shoulder 66 and the upper locking O-ring 62 may be rolled or slidably moved downwardly into the solid-line locking position thereof clearly shown in FIG. 1. This will positively re-engaed and fasten the entire device in the original condition, where it may function as a walking cane and where the debris-receiving receptacle means 30 may function as a debris-storage-and-transporting unit while the person walks to some convenient location — perhaps to a nearby gutter or public trash receptacle, or to his home — where the debris (pet's stool) can be emptied out of the debris-receiving receptacle means 30 into another trash container (or perhaps into a toilet for flushing).

It should be noted that, in the event that any very heavy loading is to be placed on the composite longitudinal cane shaft member 20 when the two portions 36 and 38 thereof are in the assembled fastened relationship shown in FIG. 1, the upper O-ring fastener means portion indicated generally at 54 may not be sufficient to positively maintain the upper ends of the two cane portions tightly together, as is desirable. There mmay be some tendency under such conditions for partial separation of the cane member portions 36 annd 38 to occur. When such loading conditions are expected, the above-mentioned partial separation of the cane member portions 36 and 38 can be avoided by the provision of an additional fastening means portion of a two-element type positioned at an intermediate or upper intermediate location a considerable distance above the bottom fastening means portion 56 and as close to the upper fastening means portion 54 as is desired. Such an additional positive fastening means portion of a two-element type is generally designated by the reference numeral 68 and comprises a first catch element or portion 70 carried in a rearwardly directed or facing position by an intermediate part of the front longitudinal cane shaft member portion 36 and a second cooperating catch element 72 carried at a similar elevation in a forwardly facing direction by the corresponding rear longitudinal cane shaft member portion 38. The specific construction of said two cooperating and controllably fastenable catch elements 70 and 72 of the intermediate fastening means portion 68 may be of the construction indicated, as is perhaps best shown in FIG. 1A, or may be of any substantially functionally equivalent construction, all within the broad scope of the present invention.

Figures 7, 8, 9, 10, 11, 12, 13:
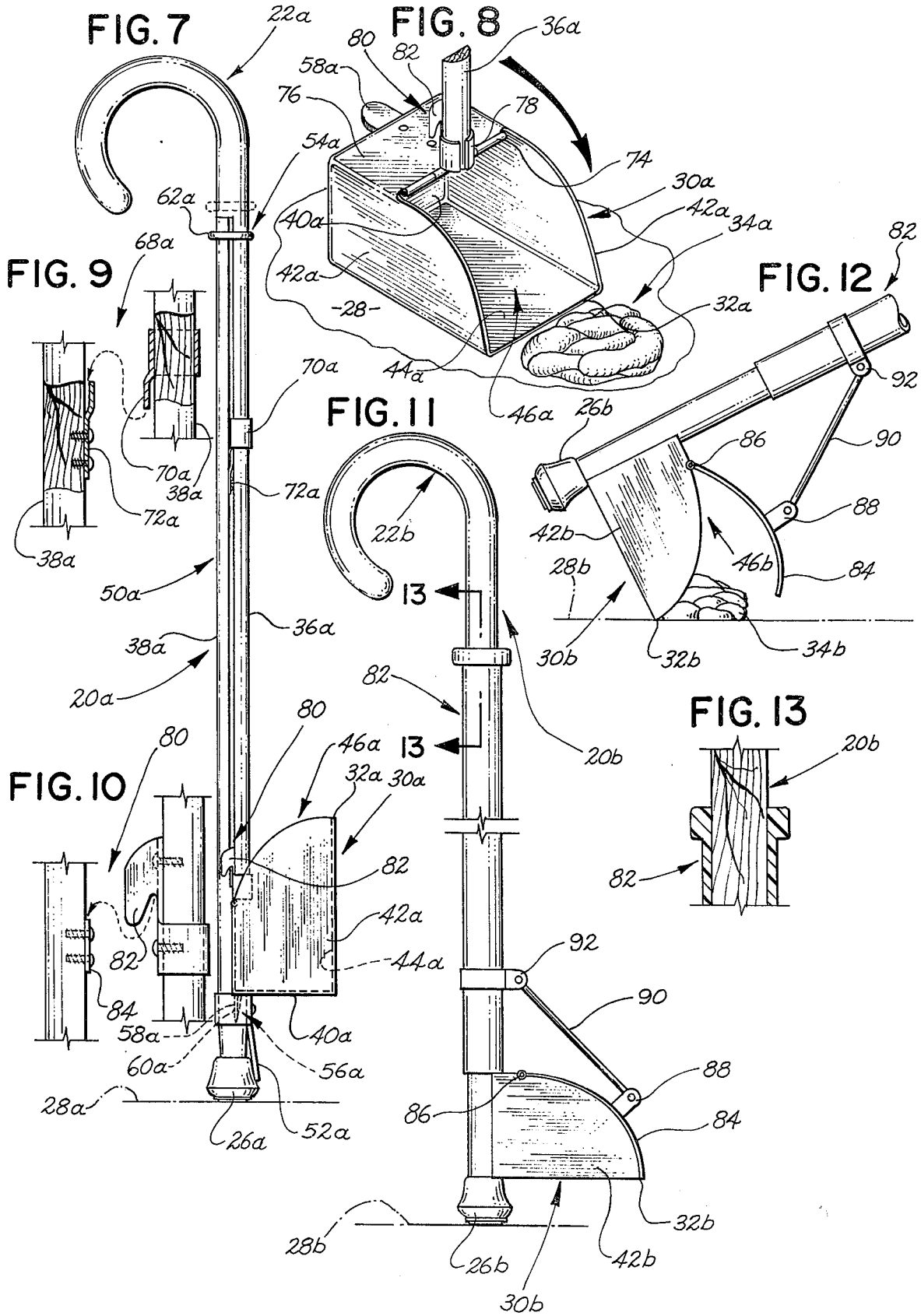
FIG. 7 illustrates a slightly modified version of the first form of the invention in an elevational view generally similar in many respects to FIG. 1 illustrating the first form of the invention, but in this modification a somewhat-different mounting arrangement for the debris-receiving receptacle means is illustrated, wherein it is hingedly mounted and carried by the front portion of the longitudinal cane shaft member rather than being fixedly attached thereto in the manner of the first form of the invention, and further wherein the engagement of the downwardly projecting fastening tongue (which is carried by the closed wall end of the debris-receiving receptacle means, which is pivotally or hingedly attached to the bottom end of the front longitudinal cane shaft member portion), when received within the corresponding downwardly directed receiving groove carried by the rear longitudinal cane shaft member portion (which actually comprises a longitudinal handle portion of the debris-movement-and-manipulation means), normally causes the hingedly mounted debris-receiving receptacle means to be held in the upwardly open, non-use position clearly shown in FIG. 7.
FIG. 8 is a fragmentary, partially broken-away, three-dimensional, pictorial, isometric view showing what occurs when the front and rear effective longitudinal cane shaft member portions are temporarily unfastened and disengaged and separated from their normally longitudinally engaged and fastened relationship shown in FIG. 1, which allows the hingedly mounted and normally retracted, upwardly open, debris-receiving receptacle means to be pivoted downwardly into an outwardly open, debris-receiving relationship resting on a ground surface, as clearly shown in FIG. 8, for the forced movement of debris, such as a dog stool, or the like, thereinto in a manner analogous to the showing of FIG. 2 illustrating the similar stool-retrieving operation in connection with the first form of the invention, which is similar in all respects to stool-retrieving operation of the second form of the invention when the debris-receiving receptacle means is in the receiving relationship clearly shown in FIG. 8. It is not believed necessary to again repeat the showing of the debris-movement-and-manipulation member since it is identical to that shown in FIG. 2 of the first form of the invention.
FIG. 9 illustrates in fragmentary, enlarged, separated relationship an additional upper intermediate two-element part of the fastening means for controllably releasably fastening together the front and rear effective longitudinal shaft member portions when in the fully assembled fastened relationship shown in FIG. 7.
FIG. 10 is another fragmentary, partially broken-away, exploded view similar in many respects to FIG. 9, but illustrating an additional auxiliary lower-positioned, two-element part of the controllably releasable fastening means adapted to controllably firmly fasten together lower parts of the front and rear effective longitudinal cane shaft member portions when in the fully-assembled-and-fastened relationship shown in FIG. 7.
FIG. 11 is a fragmentary, partially broken-away, side elevational view generally similar in aspect to FIGS. 1 and 7, but illustrating a third variation of the invention including a controllably longitudinally movable operating member, taking the form of an operating sleeve member, carried by the longitudinal cane shaft member portion and in this case being coupled by a pivotally connected operating arm member with respect to a hingedly mounted cover member carried by a debris-receiving receptacle means of substantially the same type as shown in the first form of the invention and fixedly carried by the lower part of the longitudinal cane shaft member portion. The longitudinally movable operating sleeve member functions by way of the connecting rod operating linkage as an operating means for the hingedly mounted cover means of the two-element debris-receiving receptacle means and with said operating sleeve, connecting link, and hingedly mounted cover being the effective equivalent of the debris-movement-and-manipulation means of the first and second forms of the invention and operable when placed in a debris-retrieving relationship, such as shown in FIG. 12, for the same stool-retrieving purposes as illustrated in FIG. 2 of the first form of the invention and as illustrated partially in FIG. 8 of the second form of the invention.
FIG. 12 is a fragmentary side elevational view of the lower portion of the modified or variant form of the invention shown in FIG. 11 with the operating sleeve member in an upward extreme position relative to the longitudinal cane shaft member portion for moving the cover member into an open opposed relationship with respect to an entry lip portion of the debris-receiving receptacle means whereby to be on opposite sides of a quantity of debris, such as a pet stool resting on a ground surface, for subsequent stool-retrieval as a consequence of moving the operating sleeve member downwardly relative to the longitudinal cane shaft member portion.
FIG. 13 is a fragmentary, vertical-plane, sectional view, drawn to a slightly enlarged scale, taken substantially along the plane and in the direction indicated by the arrows 13—13 of FIG. 11 whereby to indicate one form of frictional positioning of the longitudinally movable operating sleeve member of the modified variant form of the invention illustrated in FIGS. 11, 12, and 13.

FIGS. 7–10 illustrate a slight modification of the first form of the invention and corresponding parts are designated by similar reference numerals, followed by the letter *a*, however. In this modification, it will be noted that the debris-receiving receptacle means, indicated generally at 30*a*, is no longer fixed attached to a lower part of the front longitudinal cane shaft member portion 36*a* in a manner similar to the corresponding construction of the first form of the invention, but instead is hingedly attached with respect to a forward terminal hinge edge 74 (best shown in FIG. 8) of a partial top wall portion 76 of the debris-receiving receptacle means indicated generally at 30*a*. The attachment, in the example illustrated, is by means of an attachment bracket 78 fastening a conventional hinge 74 with respect to the front terminal edge of said top wall portion 76 of a debris-receiving receptacle means 30*a*, so that in effect it can be said that the entire debris-receiving receptacle 30*a* is hingedly attached to the bottom end of the front longitudinal cane shaft member portion 36*a* for movement between a retracted, non-use position thereof such as is shown in FIG. 7 (with the entry opening 46*a* thereof directed upwardly in a non-functional position) and an outwardly directed operative or use position such as shown in FIG. 8.

The maintenance of said retracted position, when the front and rear longitudinal cane portions 36*a* and 38*a* are in the assembled, fastened-together relationship shown in FIG. 7, is accomplished by reason of the fact that the fastening tongue 58*a* is carried by the rear wall 40*a* of the debris-receiving receptacle 30*a* and, therefore, is pivotally movable therewith between a downwardly directed locking position as shown in FIG. 7 and the completely unlocked and disengaged position thereof shown in FIG. 8 where said locking tongue 58*a* is rearwardly directed rather than downwardly directed. It will be readily understood that when the debris-receiving receptacle means 30*a* is hingedly moved relative to the bottom end of the front longitudinal cane shaft member portion 36*a* so as to be in the upwardly directed or retracted position shown in FIG. 7, the locking tongue 58*a* extends downwardly and is adapted to be received in the corresponding downwardly directed, groove-shaped, tongue-receiving recess 60*a* , which is identical in construction to the locking recess 60 of the first form of the invention most clearly shown in FIGS. 4 and 5, which views are not again repeated in connection with the FIGS. 7–10 modification of the invention since said locking groove 60*a* in the modified form is identical to that of the first form shown at 60 in FIGS. 4 and 5. This will, in effect, maintain the retracted position of the debris-receiving receptacle means 30*a* when the entire device is in the fastened-together relationship shown in FIG. 7. However, there is a tendency for the bottom part of the front longitudinal cane shaft member portion 36*a* adjacent to the bracket 78 at the bottom thereof to separate from the rear cane shaft member portion 38*a* when the entire cane is under load. This is because of the hinged connection provided by the hinge means 74 and, in order to eliminate this bottom-separation tendency, the previously mentioned fastening means of the first form of the invention, designated at 54 with respect to the upper portion thereof, at 56 with respect to the lower portion thereof, and at 68 with respect to an intermediate portion thereof, is further supplemented in this form of the invention by a lower intermediate fastening means, generally designated at 80, which is of a two-element type having a hook-shaped catch or fastener element 82 carried in a rearwardly facing direction by the lower part of the front longitudinal cane shaft member portion 36*a* and fasteningly cooperable with a second catch element 84 carried at a similar location, but in a frontwardly facing manner, by a lower part of the rear longitudinal cane shaft member portion 38*a*. These two elements 82 and 84 of the lower intermediate fastening means portion 80 are clearly shown in separated relationship in FIG. 10, with the broken-line arrow indicating the relative movements thereof during the fastening-together of same.

The upper intermediate fastening means, generally designated at 68*a*, is generally similar to the corresponding upper intermediate fastening means 68 of the first form of the invention and is clearly shown in disengaged relationship in FIG. 9.

The operation of the modification illustrated in FIGS. 7–10 is substantially the same as the first form of the invention. The upper fastening means portion 54*a* is controllably manually unlocked and the upper intermediate fastening means portion 68*a* and the lower intermediate fastening means portion 80 and the extreme bottom fastening means portion, indicated generally at 56*a*, are disengaged so that the entire rear longitudinal cane shaft member portion 38*a* is separated from the rest of the appartus and effectively becomes and functions as a debris-movement-and-manipulation means similar to that shown fragmentarily at 50 in FIG. 2 illustrating the first form of the invention (and not again shown in connection with this modification because of the previous showing thereof), so that the pile of debris (pet's stool) 34*a* shown in FIG. 8 can be moved into the now downwardly and outwardly hingedly displaced or pivoted debris-receiving receptacle means 30*a*, which can now receive the debris or pet's stool therein, following which the entire device can be picked up and the debris-receiving receptacle 30*a* returned to the upwardly directed, non-functional, retracted position shown in FIG. 7 and the two cane shaft member portions can be firmly fastened in the manner just described and as shown in FIG. 7, so that the device will function as a walking cane and as a temporary storing and transporting device for the previously retrieved pet's stool.

FIGS. 11–13 illustrate a further modification of the invention similar in many respects to the first form of the invention shown in FIGS. 1–7 and, therefore, parts which are structurally or functionally similar to corresponding parts of the first form of the invention are designated by similar reference numerals, followed by the letter *b*, however. In this modification, it will be noted that for the first time the longitudinal cane shaft member 20*b* is not separated into two front and rear cane shaft member half-portions such as shown at 36 and 38 of FIG. 1 of the first form of the invention, but instead the longitudinal cane shaft 20*b* is of unitary construction throughout its length, but has the functional equivalent of a second member in the provision of an operating sleeve, indicated generally at 82, which comprises a hollow tubular longitudinal sleeve member frictionally engaging the exterior surface of the inner longitudinal cane shaft member 20*b*, as is perhaps best shown in the fragmentary sectional showing of FIG. 13, so that as the longitudinal operating sleeve member 82 is manually displaced between its normal lower operating extreme position, as is best shown in FIG. 11, and an upper displaced position, as is best shown (fragmentarily) in FIG. 12, and vice versa, the effective result is the functional equivalent of the manual operation of the debris-movement-and-manipulation means 50 of the first form of the invention, as is clearly shown in FIG. 2, and in that respect it may be said that a central or intermediate portion of the complete cane shaft member 20*b* actually is of a composite or two-element construction (with one of the elements being the inner cane shaft member portion 20*b* and the other of said elements being the outer cylindrical operating sleeve member 82). In the modification of FIGS. 11–13, it should be noted that the debris-receiving receptacle means, indicated generally at 30*b*, is now of an effective two-element type including at least two relatively movable portions capable of being moved from a spaced-apart relationship (such as is clearly shown in FIG. 12) into a closely adjacent and abutting closed relationship (such as is clearly shown in FIG. 11). In the example illustrated in FIGS. 11–13, the debris-receiving receptacle means 30*b* itself comprises one element of such a two-element construction and the other element of said two-element construction comprises a curved cover portion 84 hingedly attached by hinge means 86 and, in turn, provided with a bracket 88 pivotally connected to a longitudinal connecting rod means 90 which is pivotally connected at its upper end to another attachment bracket 92 which is fastened to the previously-mentioned, longitudinally slidably movable operating sleeve member 82, thus causing the cover portion 84 to effectively function in a manner equivalent to the spatula means 52 of the first form of the invention and, when taken in conjunction with the brackets 88 and 92 and the intermediate connecting rod 90 and the operating sleeve member 82, being the functional equivalent of the debris-movement-and-manipulation means 50 of the first form of the invention, so that when the entry lip 32*b* of the receptacle means 30*b* is positioned on one side of the debris or pet's stool 34*b* and the opened outer edge of the cover portion 84 is positioned on the opposite side of the pet's stool 34*b* from the entry lip 32*b*, all that it is necessary to do to complete the debris-retrieval operation is to forcibly manually slidably move the operating sleeve member 82 from the upper position shown in FIG. 12 back toward the lower position, which will effectively close the cover portion 84 and cause the movement of the pet's stool 34*b* over the entry lip 32*b* into the hollow interior of the debris-receiving receptacle means 30*b*, which can then be transported to a convenient disposal location, with the entire device functioning as a walking cane during the transporting operation.

FIGS. 14 and 15 illustrate a further slight variation of the form of the invention illustrated in FIGS. 11–13, with the major change comprising primarily a relative positioning reversal of the two movable elements of the debris-receiving receptacle means, which is generally designated in this modification by the reference numeral 30*c*, and the cover portion thereof which, in this modification, is designated by the reference numeral 84*c*. Because this is a slight variation of the previously described form, corresponding parts are designted by similar reference numerals, followed by the letter *c*. It should be noted that the balance of the device, exclusive of the debris-receiving receptacle means 30*c* and the cover portion 84*c* thereof are substantially identical to the showing of the previously described form of the invention illustrated in FIGS. 11–13 and, therefore, will not again be described in detail. It should suffice to state that in this case the longitudinally slidably movable operating sleeve member 82*c* is pivotally coupled by the connecting rod means 90*c* to the attachment bracket 88*c* which, however, is attached to a back portion of the debris-receiving receptacle means 30*c* instead of being attached to the cover portion 84*c* in the manner of the previously described form of the invention as shown in FIGS. 11–13. Also, in this modification, the cover portion 84*c* is of flat configuration rather than being arcuately shaped and is fixedly attached by the bracket member 94 to the lower part of the longitudinal cane shaft member 20*c* so that vertical slidable movement of the operating sleeve member 82*c* between its lower position as shown in FIG. 14 and its upper position as shown in FIG. 15 relatively moves the main body portion of the debris-receiving receptacle means 30*c* with respect to the fixedly positioned cover portion 84*c* between the closed relationship of FIG. 14 and the open relationship of FIG. 15, and vice versa. Of course, it should be clearly understood that when the movement of the operating sleeve member 82*c* into the upper position produces the opening relationship of the debris-receiving receptacle means 30*c* with respect to the cover portion 84*c*, as shown in FIG. 15, normally the entire device will then be tilted until the entry lip edge portion 32*c* of the debris-receiving receptacle means engages the ground surface 28*c* on the opposite side of the pet's stool (not shown) from the engagement of the outer edge of the cover portion 84*c* with such a ground surface. In other words, the device as shown in FIG. 15 will normally be tilted in the manner shown in FIG. 12 illustrating the previously described form of the invention so that the subsequent closing movement produced by downward movement of the operating sleeve member 82*c* will effectively retrieve and receive within the hollow interior of the debris-receiving receptacle means 30*c* any such pet's stool (which is not shown in FIG. 15 because it already has been illustrated). The vertical positioning shown in FIG. 15 rather than the inclined positioning thereof in the manner of FIG. 12 is entirely for drawing space-saving reasons. Otherwise, the FIGS. 14 and 15 modification functions substantially the same as the modification of FIGS. 11–13, and it is thought that, in view thereof, any further description would be redundant.

The modification illustrated in FIGS. 16 and 17 is, in effect, a composite of the version of FIGS. 14 and 15 and the earlier-described version of FIGS. 7–10 in that it includes a slidably mounted operating sleeve manner 82*d* of the type shown in the version of FIGS. 11–13 and the version of FIGS. 14 and 15 in that it includes a hingedly mounted, debris-receiving receptacle means of the same type as that illustrated in the previously described version of FIGS. 7–10. Therefore, parts corresponding to the previously-described forms of the invention are designated by similar reference numerals, followed by the letter *d*, however. In this modification, the longitudinally slidably movable operating sleeve member 82*d* is pivotally connected by the connecting rod 90*d* to an outer pivotal attachment point 96 of the debris-receiving receptacle means, indicated generally at 30*d*, and which, in turn, is pivotally mounted by the hinge 74*d* attached to the attachment mounting bracket 94*d* carried by a lower part of the longitudinal cane shaft member 20*d* for movement between the normal retracted, effectively inoperative relationship, shown fragmentarily in FIG. 17, and the operative, functional, outwardly projecting and outwardly open relationship of the debris-receiving receptacle means 30*d* as shown in FIG. 16. Of course, it is understood that the entire apparatus is tilted somewhat to the right from the vertical position shown in FIG. 16 so that entry lip edge portion 32*d* will actually rest on the ground surface 28*d* when retrieval of a quantity of debris, such as a pet's stool (not shown) is to be achieved by effectively scooping and sliding the entry lip edge portion 32*d* thereunder, followed by the slidable upward movement of the operating sleeve member 82*d* and the corresponding upward pivoting of the debris-receiving receptacle means 30*d* into the retracted inoperative debris-transporting relationship shown fragmentarily in FIG. 17.

It should be noted that the cane, and the cane portions, of the apparatus of the present invention may be made of wood in the conventional manner of many prior art canes or may be made of extruded, molded, or formed construction of plastic or may be of formed metallic construction, in which case some of the parts, such as the longitudinal cane shaft member, may be hollow or tubular for weight-reduction purposes. The debris-receiving receptacle means and certain of the fastening elements, hinge means, and the like, may be made of metal in the conventional manner of such highly-stressed structures or may be made of heavier-gauge, formed plastic construction. In those forms of the invention which have the longitudinal slidable sleeve operating member, it may be made of extruded plastic or metal construction or various other types of formed construction of various suitable materials. The cane tip is preferably made of a compressible elastomeric material which may be plastic, rubber, or the like.

It should be understood that the figures and the specific description thereof set forth in this application are for the purpose of illustrating the present invention and are not to be construed as limiting the present invention to the precise and detailed specific structure shown in the figures and specifically described hereinbefore. Rather, the real invention is intended to include substantially equivalent construction embodying the basic teachings and inventive concept of the present invention.

What is claimed is:

1. A debris-retrieving cane, comprising: a longitudinal cane shaft member effectively provided at an upper end thereof with a handle member portion and effectively provided at a bottom end thereof with a ground-surface-engageable cane tip member portion, said longitudinal cane shaft member being provided adjacent to said bottom end thereof with a hollow debris-receiving receptacle means having a ground-surface-engageable entry lip portion movable into engagement with a ground surface for positioning adjacent to a quantity of debris which is to be removed and, in such position, defining at least a portion of a receiving entry opening provided in said debris-receiving receptacle means and effectively communicating the exterior and the hollow interior thereof, said debris-receiving receptacle means being effectively positioned with respect to a lower portion of said cane shaft member in a manner capable of being placed with said ground-surface-engageable entry lip portion projecting from said cane shaft member in a direction such as to be capable of engagement with a ground surface and with said entry opening effectively open for the reception of a quantity of debris which is to be removed; and debris movement and manipulation means for effectively moving and manipulating a quantity of debris which is to be removed along a ground surface initially supporting such debris toward the ground-surface-engaged entry lip portion for forced movement thereover and through said entry opening into said hollow interior of said debris-receiving receptacle means said debris-movement-and-manipulation means comprising a longitudinal handle portion and an effective debris-engaging spatula portion at the bottom end of said longitudinal handle portion normally mounted in longitudinal, laterally adjacent, substantially parallel relationship with respect to a corresponding longitudinal part of said longitudinal cane shaft member and provided with controllably openable and closeable fastening means for normally fastening and retaining said longitudinal handle portion and said debris-engaging spatula portion at the bottom thereof immediately adjacent to and in longitudinal contiguous relationship with respect to said part of said cane shaft member until controllable manual unfastening thereof, said fastening means, when controllably unfastened, effectively releasing said longitudinal handle portion of said debris-movement-and-manipulation means whereby to allow said lower debris-engaging spatula portion thereof to move into a position spaced from but adjacent to and movable toward said ground-surface-engageable entry lip portion of said debris-receiving receptacle means and said entry opening defined thereabove when in the debris-receiving operative position.

2. A device as defined in claim 1, wherein said controllably openable and closable fastening means effectively comprises an upper longitudinally manually movable constraining ring member adapted when in a lower fastening position to constrain toward each other into effectively fastened relationship an upper part of said longitudinal handle portion of said debris-movement-and-manipulation meand and an adjacent upper part of said longitudinal cane shaft member, and further comprises a lower effective two-element positioning means with one of said elements being carried at the bottom of said longitudinal cane shaft member and taking the form of a projecting tongue member and with the other element being carried at a corresponding receiving location by a lower part of said debris-movement-and-manipulation means and comprising a corresponding mating tongue-member-receiving, grooved recess means whereby to provide for effectively positioning and positively attaching together adjacent lower parts of said longitudinal cane shaft member and said longitudinal handle portion of said debris-movement-and-manipulation means when in fastened relationship.

3. A device as defined in claim 2, wherein said ground-surface-engageable cane tip member portion is actually attached to and extends downwardly from the bottom part of said longitudinal handle portion of said debris-movement-and-manipulation means, and thus effectively extends downwardly from the corresponding bottom end of said longitudinal cane shaft member at the bottom fastening location thereof, thus effectively providing the longitudinal cane shaft member with said ground-surface-engageable cane tip member portion which is adapted to be provided with and to carry a compressible elastomeric friction-providing cane tip slip-over sleeve member.

4. A device as defined in claim 1, wherein said debris-receiving receptacle means is effectively vertically hingedly attached to a lower portion of said cane shaft member at a location adjacent to the opposite end of said debris-receiving receptacle from the entry opening defining portion thereof, and is further provided with positioning means effectively cooperable with respect to said movably mounted, debris-receiving receptacle means for normally positioning it in an effectively upwardly open position with said entry opening substantially at the top thereof, said positioning means being controllably releasable whereby to effectively cause said movable mounted debris-receiving receptacle means to hingedly move outwardly and downwardly into an effectively outwardly directed position with respect to the lower part of said cane shaft member in an outwardly effectively open position with said ground-surface-engageable entry lip portion being substantially outwardly positioned and with said entry opening being positioned thereabove in a substantially outwardly open relationship.

5. A device as defined in claim 4, wherein said controllably openable and closable fastening means has a lower portion effectively comprising positioning means and effectively providing for cooperative interengagement between a lower part of said debris-movement-and-manipulation means and said vertically hingedly mounted debris-receiving receptacle means when in said normal retracted, upwardly open relationship for maintaining said retracted, upwardly open relationship and positioning of said debris-receiving receptacle means until the controllable unfastening of said bottom fastening portion which functions to effectively release said previously retracted positioning of said debris receiving receptacle means.

* * * * *